United States Patent [19]

Johnson et al.

[11] Patent Number: 4,664,619

[45] Date of Patent: May 12, 1987

[54] BURNER NOZZLE

[75] Inventors: Carl H. Johnson, Denton; Charles D. Coppedge, Lewisville; Charles S. McCasland, Westminster, all of Tex.

[73] Assignee: Otis Engineering Corporation, Carrollton, Tex.

[21] Appl. No.: 818,778

[22] Filed: Jan. 14, 1986

Related U.S. Application Data

[63] Continuation-in-part of Ser. No. 802,830, Nov. 29, 1985.

[51] Int. Cl.[4] ..... F23D 11/36

[52] U.S. Cl. ..... 431/154; 431/187; 431/119; 239/120; 239/424.5

[58] Field of Search ..... 431/190, 187, 154, 202, 431/354, 119; 239/104, 120, 403, 404, 423–424.5

[56] References Cited

U.S. PATENT DOCUMENTS

| | | | |
|---|---|---|---|
| 2,325,495 | 7/1943 | Ferguson | 239/403 |
| 2,482,260 | 9/1949 | Goddard | 431/190 X |
| 2,636,778 | 4/1953 | Michelsen | 239/403 |
| 3,164,200 | 1/1965 | Reed | 239/403 X |
| 3,228,612 | 1/1966 | Graham et al. | 239/423 X |
| 3,394,888 | 7/1968 | Dasse et al. | 239/424 |
| 3,460,911 | 8/1969 | Krejci et al. | 431/154 X |
| 3,827,632 | 8/1974 | Rymarchyk et al. | 239/423 X |
| 4,011,995 | 3/1977 | Krause, Jr. | 239/404 |
| 4,427,367 | 1/1984 | Yagisawa | 431/187 X |

*Primary Examiner*—Randall L. Green
*Attorney, Agent, or Firm*—Vinson & Elkins

[57] ABSTRACT

A burn nozzle for mixing petroleum products to be burned and air in which air is injected into the petroleum stream leaving a nozzle from an air can which is spaced from the nozzle and its petroleum product supply line such that any leakage from the oil supply line is into a space between the line and the air can and the petroleum products cannot be forced under pressure into the air can. The air can may be provided with a slip joint to accommodate unequal heating of the air can. The free end of the oil conduit and its outlet chamber may be smaller in diameter than the oil can and be threaded to the remainder of the oil conduit to permit its ready removal and replacement.

8 Claims, 5 Drawing Figures

BURNER NOZZLE

This application is a continuation-in-part of our pending application Ser. No. 802,830, filed Nov. 29, 1985, abandoned.

This invention relates to burner nozzles and particularly to nozzles for burning petroleum products during well testing.

Burner nozzles in which petroleum products are burned and in particular to dispose of the products of oil well testing are well known. See the patent to Krause, U.S. Pat. No. 4,011,995, which shows such a nozzle with petroleum products and air mixed by the nozzle to facilitate burning of the petroleum products.

Where the air supply can surrounds the oil line as in the Krause patent, it is possible for oil to be forced under pressure into the air can and its supply line in the event of rupture of the oil line which is, of course, undesirable.

It is, therefore, an object of the invention to provide a burner nozzle in which rupture of the oil conduit cannot result in forcing oil into the air conduit under pressure.

Another object is to provide a burner nozzle with a tubular oil conduit and a concentric outer air can in which the air can is spaced from the oil conduit such that a rupture of the oil conduit cannot result in forcing of oil into the air conduit.

Another object is to provide a burner as in the preceding objects in which pipe union connectors are provided on the oil and air conduits for rapid connection and disconnection of the nozzle from its air and oil supply lines.

Another object is to provide a burner nozzle as in the above objects in which the oil conduit includes a tubular oil conduit extension and the nozzle chamber from which oil exits is a one piece welded assembly welded to the tubular oil conduit extension with a threaded connection between the extension and remainder of the oil conduit to permit ready replacement of the oil nozzle chamber.

Another object is to provide a burner nozzle having an oil conduit surrounded by an air can spaced radially therefrom in which the free end of the oil conduit and its associated chamber can be removed without removal of the air can.

Another object is to provide a burner nozzle having an oil conduit surrounded by an air can spaced radially therefrom in which the air can has an inner and outer tube, and a slip connection in the air can permits uneven heating of the air can without placing the air can under stress.

Other objects, features and advantages of the invention will be apparent from the drawing, the specification and the claims.

In the drawing wherein an illustrative embodiment of this invention is shown and wherein like reference numerals indicate like parts, FIG. 1 is a view partially in elevation and partially in section of a burner nozzle constructed in accordance with this invention and the oil and air supply lines therefor;

Figures 1, 2:
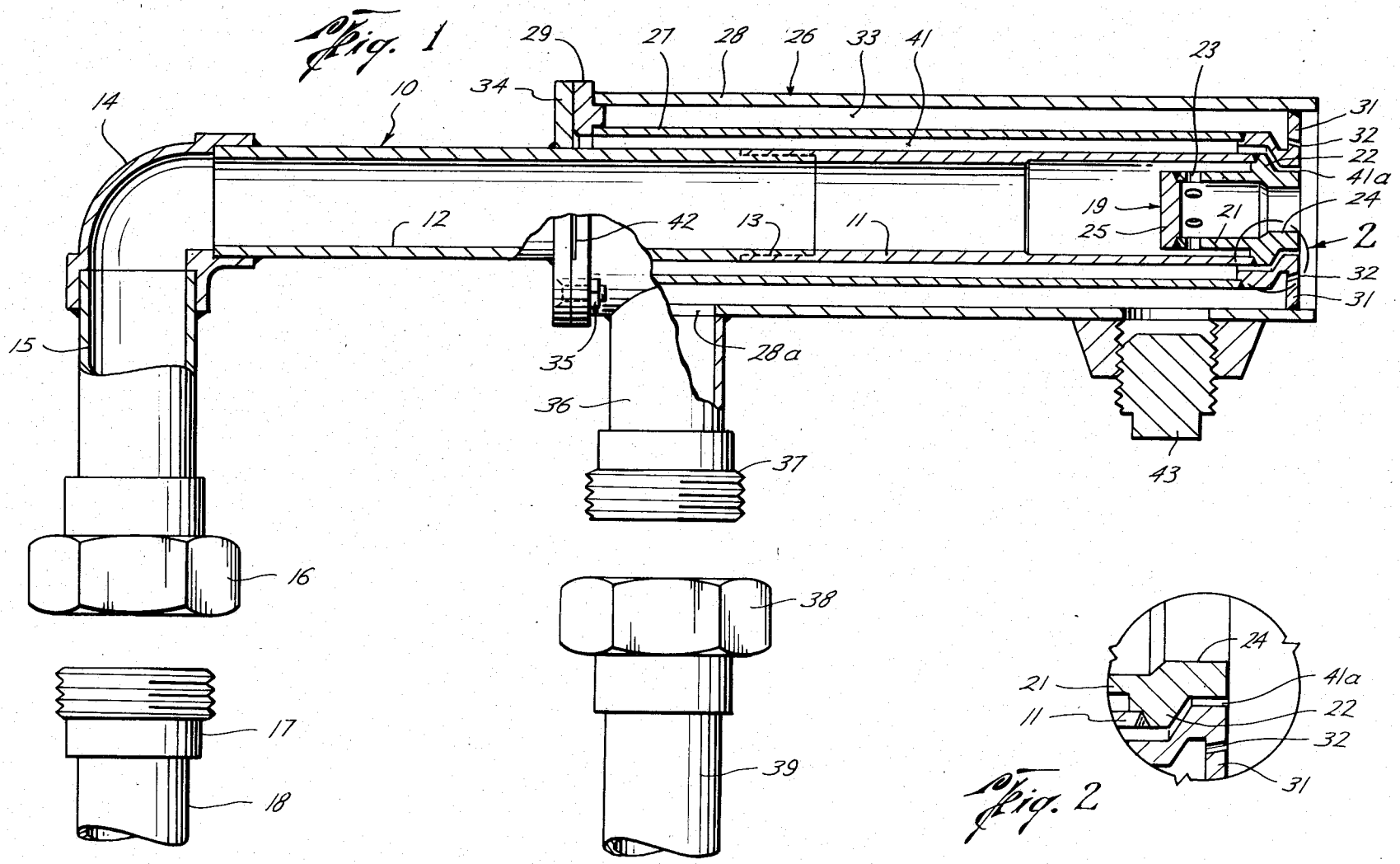
FIG. 2 is an enlarged view of the circled area indicated at 2 on FIG. 1.

The burner includes tubular oil conduit means indicated generally at 10. The tubular oil conduit includes the tubular oil conduit extension 11 which is secured to the main tubular oil conduit 12 by a threaded connection 13. Preferably this threaded connection is of the type known in the oil industry as a premium connection as such a connection provides maximum strength and resistance to leaks therethrough. The tubular oil conduit means 10 includes an elbow 14 secured to the conduit 12 and a downwardly extending conduit section 15 on which a pipe union nut 16 is mounted. This pipe union nut 16 cooperates with the male fitting 17 on the oil supply line 18 and provides a method of quick connection to the oil supply line and provides a part of the support for the nozzle.

At the free end of the tubular oil conduit extension 11, there is provided a cup-shaped chamber indicated generally at 19 which receives oil from the tubular oil conduit means and projects it from the nozzle with a swirling motion. The chamber 19 includes a tubular portion 21 which has an external flange 22 which is welded to the free end of the tubular oil conduit extension 11. This tubular section 21 also has a plurality of angled generally radially extending ports 23 which receive oil from the conduit 10 and conduct it into the interior of the tubular member 21 and forces it to swirl as it passes through the conduit 21 and through the exit throat 24 of the chamber. The internal end of the chamber is closed by the cap 25 which is welded to the tubular section 21.

Air can means indicated generally at 26 is provided concentric with the tubular oil conduit. This can is larger in diameter than the oil conduit and includes the radially spaced internal tube 27 and external tube 28. These two tubes are joined at one end by the spacer 29. At the other end the tubes are joined by a spacer 31 having a plurality of circumferentially arranged air exit holes 32 which direct air from the annulus 33 within the air can into the oil leaving the throat 24 of the chamber means.

An exterior mounting flange 34 is carried by the tubular oil conduit.

The air can spacer 29 may be secured to the mounting flange 34 by any desired means such as a plurality of bolts and nuts, one of which is shown at 35. The mounting is such that the air can spacer 31 is positioned relative to the throat 24 of the chamber such that air passing through the holes 32 will mix in the desired manner with oil from the chamber 19.

The air can 26 has its external tubular member 28 ported at **28*a* and a downwardly extending air conduit 36 is welded about the port 28*a* and carries at its lower end the male fitting 37 to cooperate with the pipe union nut 38 on the air supply line 39. If needed shims may be placed between the flange 34 and the spacer 29 to mate the oil line and air line with their supply conduits 18 and 39**. It will be appreciated that the entire mozzle may be supported from the air and oil supply conduits and the quick release connection provided by the pipe unions permits ready removal and exchange of the entire nozzle.

It is also apparent that the chamber 19 may be readily exchanged by releasing the air supply union nut 38, removing the bolts and nuts 35 and extracting the entire air can. This exposes the tubular oil conduit extension 11 and by breaking out thread 13 this extension and the chamber 19 may be readily replaced.

The relationship of the air can to the oil conduit is such that the air can is circumferentially arranged and radially spaced from the oil conduit means 10 about the entire circumference of the oil conduit from the flange 34 to the free end of the air can as represented by the spacer 31. This provides the open annulus 41 between the tubular oil conduit 10 and the air can 26. This annulus has an outlet 41*a* at the chamber end of the burner and any leakage of oil from the tubular oil conduit between the flange 34 and the throat end of the chamber 19 may pass through this annulus 41 and out through the space 41*a*.

Also, if desired provision may be made for additional exit of fluid from the escape annulus 41 by providing one or more grooves 42 extending radially through the attachment spacer 29. The groove 42 extends from the escape annulus 41 to the exterior of the attachment spacer 29 and thus any leakage occurring between the attachment flange 34 on the tubular oil conduit and the free end of the burner may escape not only through the annulus 41*a* at the free end of the burner but also through one or more grooves 42 between the spacer 29 and the mounting flange 34. In this way oil under pressure is provided an escape route in the event of any leakage through the tubular oil conduit on the exit side of the flange 34 and where it is coextensive with the air can 26.

A ball plug 43 is provided between the exterior and the lower portion of the air can adjacent the spacer 31 to assist of clean-out of the air can if needed.

Figures 3, 4, 5:
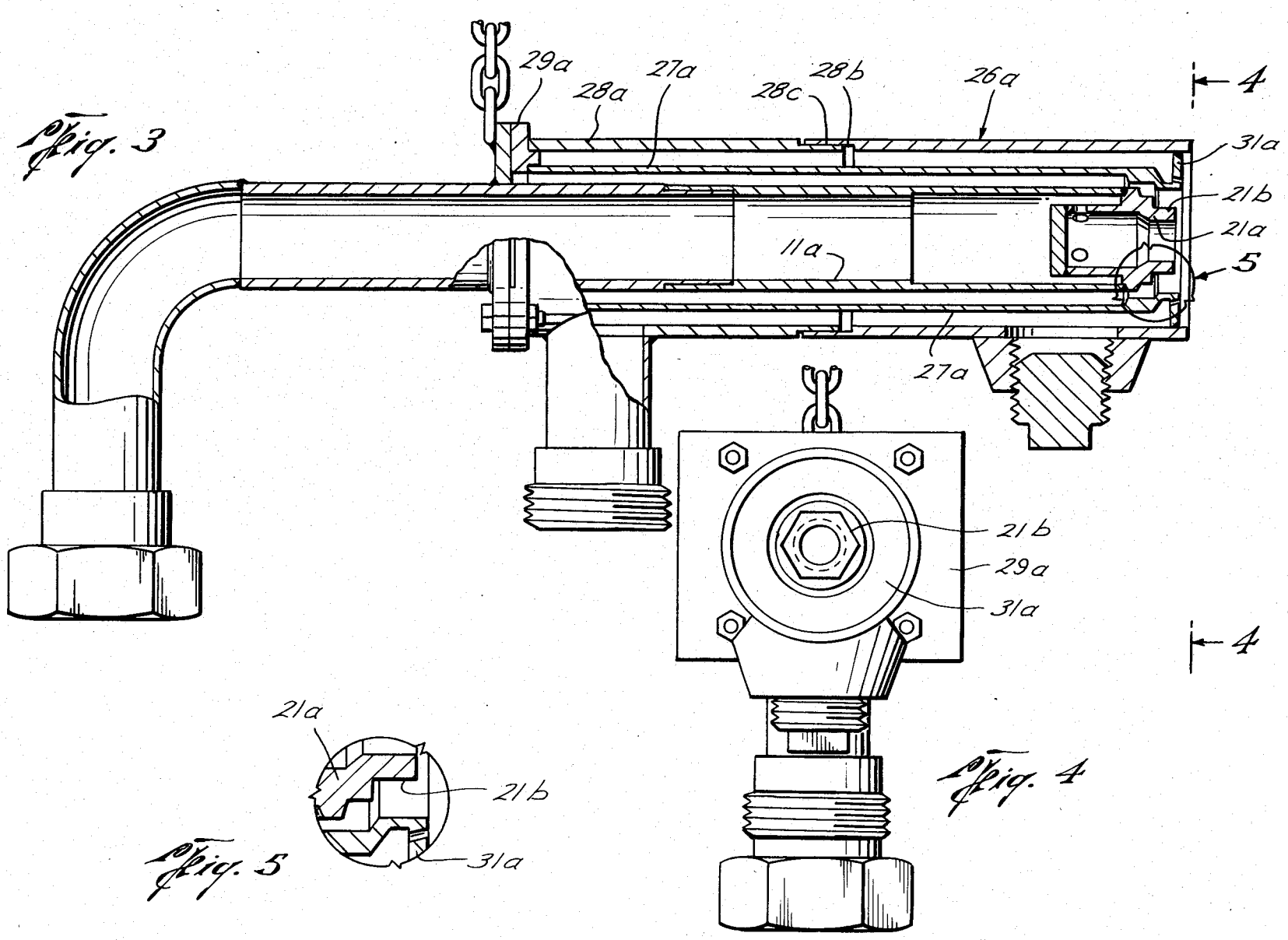
FIG. 3 is a view similar to FIG. 1 of a modified form of this invention.
FIG. 4 is a view taken along the lines of 5—5 of FIG. 3.
FIG. 5 is an enlarged view of the circled area indicated at 5 on FIG. 3.

FIGS. 3, 4 and 5 illustrate a modified form of burner which is substantially identical to the FIG. 1 form of burner except that provision is made for a heat slip joint in the air can to prevent stresses from being induced in the air can due to uneven heating, and the chamber 21*a* and its associated portion of the oil conduit can be removed without disturbing the air can.

In this form of the invention, the chamber means 21*a* and the oil conduit 11*a* on the chamber side of the threaded connection 13 have a maximum diameter which is less than the minimum diameter of the air can indicated generally at 26*a*. Thus, the outer diameter of the oil conduit 11*a* between the thread 13 and its end secured to the chamber 21*a* has a diameter which is less than the air can inner tube 27*a* and the flange connection 31*a*. With this relationship, the oil conduit to the right of the thread 13, as viewed in FIG. 3, may be removed by breaking out the thread 13 and withdrawing the released oil conduit and the chamber 21*a* for replacement by a repaired or new conduit section 11*a* and chamber 21*a*. From FIGS. 3 and 5, it will be noted that the smallest diameter portion of the air can occurs at the external spacer 31*a* and that the largest diameter of the oil conduit 11*a* and the chamber 21*a* is less than the smallest diameter portion of the spacer 31*a*. Thus the entire air can from the thread 13 to the free end of the burner is larger in diameter than the removable section of the oil conduit and chamber. This permits easy breaking out and making up of the thread 13 without disturbing the air can.

Preferably, the removable portion of the oil conduit, that is the portion between the thread 13 and the chamber 21*a*, is specially treated to reduce abrasion from the material flowing therethrough. For instance the interior surface of this portion of the oil conduit might be case hardened or nitrided.

To facilitate making up and breaking out the chamber and section of the oil conduit, the end of the chamber 21*a* is provided with wrench means such as the wrench flats 21*b* best seen in FIG. 4.

In order to provide for uneven heating of the air can, a slip joint is provided which prevents the can from being placed under stress when heated. Uneven heating may occur under several circumstances such as where the burner is one of an assembly of several burners and only a single burner is operating.

The inner tube 27*a* of the burner should be impervious as should its connection with the two spacers 29*a* and 31*a* to prevent oil from the oil conduit from finding its way into the air annulus 33*a* within the can 26*a*. For this reason the slip joint should involve the outer tube 28*a* of the air can. While the slip joint could be provided by any part of the outer conduit such as by a slip connection with either of the spacers 29*a* or 31*a*, it is preferred that the spacers not be involved. Preferably the slip joint is provided by forming the outer tube 28*a* in two parts with a telescoping connection therebetween, provided by the counterbore 28*b* on one section, having a sliding connection with a reduced diameter end 28*c* of the other section of the outer tube. This telescoping slip joint preferably is machined to provide a small loss of air while permitting the two parts to telescope relative to each other under uneven heating of the air can so that stresses will not be set up in the air can due to such uneven heating tending to lengthen the inner or outer tubes by unequal amounts. For instance the clearance between the reduced diameter pin 28*c* and the counterbore 28*b* might be from three to twelve one thousandths of an inch. This would permit the two sections of the outer tube to slide relative to each other and at the same time reduce air loss through the slip connection to a small amount which can be accommodated by slightly increasing the air pressure used in the system.

The foregoing disclosure and description of the invention are illustrative and explanatory thereof and various changes in the size, shape and materials, as well as in the details of the illustrated construction may be made within the scope of the appended claims without departing from the spirit of the invention.

What is claimed is:

1. A burner nozzle comprising, tubular oil conduit means, chamber means attached to the outlet end of the oil conduit means and directing oil from the nozzle, air can means concentric with and larger in diameter than said oil conduit means, said air can means including radially spaced internal and external tubes and a spacer at each end of said tubes extending between said tubes to provide said radial spacing with one spacer adjacent said chamber means, a plurality of circumferentially spaced holes in the spacer adjacent said chamber means for directing air into the oil exiting said chamber means, exterior flange means carried by said oil conduit means, and means securing one end of said air can means to said flange means and spacing said air can means radially from said oil conduit means about its entire circumference between said air can means spacers to provide an escape path for any oil escaping from the oil conduit means along its entire length from said flange means to the other end of said air can means so that any rupture of the oil conduit means will not result in oil being forced into the air conduit means.

2. The nozzle of claim 1 wherein the oil conduit means and air can means are provided with union connectors to permit rapid connection and disconnection of the nozzle from its oil and air supply lines.

3. The nozzle of claim 1 wherein said tubular oil conduit means includes a tubular oil conduit extension means with a threaded connection therebetween and said chamber is a one piece welded assembly welded to said oil conduit extension means.

4. The nozzle of claim 1 wherein one spacer of said air can abuts said exterior flange and means is provided in said one spacer connecting the annulus between the air can and the tubular oil conduit to the exterior of the nozzle.

5. The nozzle of claim 1 wherein threaded connection means are provided in said oil conduit means between said flange means and said chamber means, said chamber means and said oil conduit means along its length between said chamber means and said threaded connection having a maximum diameter less than the minimum diameter of said air can means from said threaded connection to the other end of said air can means, and wrench means on one of said chamber means and said oil conduit means facilitating making and breaking of said threaded connection without removal of said air can means.

6. The nozzle of claim 1 wherein said air can means has a slip connection permitting uneven heating of the air can means without placing the air can means under stress, at least one element of said slip connection provided by said external tube.

7. The nozzle of claim 1 wherein threaded connection means are provided in said oil conduit means between said flange means and said chamber means, said chamber means and said oil conduit means along its length between said chamber means and said threaded connection having a maximum diameter less than the minimum diameter of said air can means from said threaded connection to the other end of said air can means, and wrench means on one of said chamber means and said oil conduit means facilitating making and breaking of said threaded connection without removal of said air can means, said air can means has a slip connection permitting uneven heating of the air can means without placing the air can under stress, at least one element of said slip connection provided by said external tubing.

8. The nozzle of claim 1 wherein said external tube of said air can has a slip connection intermediate its ends permitting uneven heating of the air can means without placing the air can means under stress.

* * * * *